US007753550B2

(12) United States Patent
Engel

(10) Patent No.: US 7,753,550 B2
(45) Date of Patent: Jul. 13, 2010

(54) RECESSED LIGHTING FIXTURE

(75) Inventor: Hartmut S. Engel, Monrepos Strasse 7, Ludwigsburg (DE) 71634

(73) Assignee: Hartmut S. Engel, Ludwigsburg (DE)

( * ) Notice: Subject to any disclaimer, the term of this patent is extended or adjusted under 35 U.S.C. 154(b) by 114 days.

(21) Appl. No.: 10/584,512

(22) PCT Filed: Nov. 26, 2004

(86) PCT No.: PCT/EP2004/013461

§ 371 (c)(1),
(2), (4) Date: Mar. 20, 2007

(87) PCT Pub. No.: WO2005/066538

PCT Pub. Date: Jul. 21, 2005

(65) Prior Publication Data

US 2007/0274081 A1 Nov. 29, 2007

(30) Foreign Application Priority Data

Dec. 23, 2003 (DE) ..... 103 60 945

(51) Int. Cl.
*F21S 8/00* (2006.01)

(52) U.S. Cl. ..... 362/147; 362/150; 362/222; 362/236; 362/297; 362/298

(58) Field of Classification Search ..... 362/364, 362/147, 148, 150, 236, 261, 266, 291, 297, 362/298, 299, 300, 302–305, 307, 310, 311, 362/404, 431, 222, 223, 311.01
See application file for complete search history.

(56) References Cited

U.S. PATENT DOCUMENTS

| | | | | |
|---|---|---|---|---|
| 3,833,803 | A * | 9/1974 | Heritage | 362/285 |
| 4,186,433 | A * | 1/1980 | Baldwin | 362/263 |
| 5,957,573 | A * | 9/1999 | Wedekind et al. | 362/365 |
| 6,561,670 | B1 * | 5/2003 | Jongewaard et al. | 362/147 |
| 7,118,253 | B1 * | 10/2006 | Simon | 362/328 |
| 2003/0058652 | A1 * | 3/2003 | Arumugusaamy et al. | 362/327 |

FOREIGN PATENT DOCUMENTS

| | | | |
|---|---|---|---|
| DE | 4443916 | C1 | 5/1996 |
| DE | 19507333 | A1 | 9/1996 |
| EP | 0678700 | A1 | 10/1995 |
| EP | 1033530 | A2 * | 9/2000 |
| FR | 2135928 | A | 12/1972 |

* cited by examiner

*Primary Examiner*—Sandra L O'Shea
*Assistant Examiner*—Mary Zettl
(74) *Attorney, Agent, or Firm*—Gifford, Krass, Sprinkle, Anderson & Citkowski, P.C.

(57) ABSTRACT

The invention relates to a recessed lighting fixture comprising a holder for fixing a mounting surface, in particular in a room ceiling consisting of an illuminant holder and a reflector. The holder and the reflector are disposed with respect to each other in such a way that the reflector extends in the direction of a main lighting beyond the mounting surface when the recessed lighting is fixed thereto. In said area extending beyond the mounting surface, the reflector is connected to a reflective element which is vertically or angularly oriented with respect to the direction of the main lighting and is disposed outside of the reflector for receiving the light in the area between the mounting surface and the reflective element.

21 Claims, 6 Drawing Sheets

RECESSED LIGHTING FIXTURE

CROSS-REFERENCE TO RELATED APPLICATIONS

This application is a National Stage of International Application No. PCT/EP2004/013461, filed Nov. 26, 2004, and which claims the benefit of DE 103 60 945.8, filed Dec. 23, 2003. The disclosures of the above applications are incorporated herein by reference.

FIELD

The invention relates to a built-in lamp having a holder for fastening in an installation surface, in particular a room ceiling, having an illuminant fitting and having a reflector.

BACKGROUND

The statements in this section merely provide background information related to the present disclosure and may not constitute prior art.

Built-in lamps of this kind are known from the prior art in a variety of forms. Dark-light lamps are known, among others, in which the illuminant and the reflector are arranged with respect to one another such that the illuminant can no longer be seen from a specific angle of view and thus cannot develop any glare effect. This avoidance of a glare effect, however, also results in the ceiling region of a space illuminated in this manner remaining largely non-illuminated and in the relationship between the light source and the illuminated region perceived as natural by a person being lost, since it cannot be recognized from which light source the light originates.

This effect is alleviated in accordance with the prior art in that a partly or completely frosted glass pane is secured in the region of the reflector opening disposed in the direction of illumination or beneath it in order to hereby generate diffuse light. However, the portion of the directed, direct light is thus partly or completely reduced, which is in turn disadvantageous.

Furthermore, built-in lamps are known from the prior art which avoid the aforesaid effect. With these built-in lamps, scattering reflectors, for example white reflectors, are used instead of specularly reflecting reflectors. These scattering reflectors mean that the light source or its illuminated reflector becomes visible at practically all angles of observation, albeit with a disadvantageous glare effect again occurring.

SUMMARY

An object of the invention consists of further developing a built-in lamp of the initially named kind such that in each case, on the one hand, a glare effect is avoided in accordance with the dark-light principle and such that, on the other hand, it is ensured that the persons located in the illuminated room can perceive the light sources used for illumination consciously or even unconsciously such that a natural relationship is created between the light source and the illuminated region and a warm room climate is obtained in a technical lighting manner.

In accordance with the invention, the object is satisfied in particular in that the holder and the reflector are arranged relative to one another such that the reflector extends beyond the installation surface in a main direction of illumination, when the built-in lamp is secured in the installation surface, with the reflector being coupled in this region, which extends beyond the installation surface, to a reflection element extending perpendicular or at an angle to the main direction of illumination and arranged outside the reflector, said reflection element being able to be illuminated by light via the region lying between the installation surface and the reflection element.

In accordance with the invention, the reflector opening disposed in the main direction of illumination is therefore not located in the plane of the installation surface as with conventional built-in lamps in accordance with the prior art, but beneath this plane, which means that the reflector projects out of the installation surface in the main direction of illumination. In this manner, in its region projecting out of the installation surface, the reflector forms a securing possibility for the reflection element in accordance with the invention which extends outside the reflector, for example around it. This reflection element can now be illuminated by light in any desired manner from above via the region disposed below the installation surface and the reflection element so that this portion of the light is reflected by the reflection element in the direction of the installation surface, for example a room ceiling. In this manner, a lighting of the installation surface ultimately results from below in that the said portion of the light coming from the reflection element provides a "natural" ceiling brightening. In accordance with the invention, it is therefore possible to work according to the known dark-light principle at the interior of the reflector and the advantages resulting therefrom can be utilized, with a lighting of the installation surface, however, simultaneously taking place around the reflector. This lighted region of the installation surface is always visible for the eye of the observer so that a visible marking of the light source is always ensured, which results in a room mood with a good light atmosphere felt to be pleasant despite the use of the dark-light principle. In addition, a generation of softer shadows and an advantageous wall brightening is achieved by the light which is reflected toward the installation surface and which in turn is directed from there as scattered light into the room to be lighted. Furthermore, a disadvantage shading of faces is avoided which usually occurs with a direct lighting from above.

In addition to these advantages, interesting design possibilities result from the reflection element in accordance with the invention, for example by an individual selection of the shape or of the color of the reflection element.

The reflection element can be made as reflecting or as specularly reflecting at its side facing the installation surface. It is of advantage with this embodiment that the total light incident onto the reflection element from above is reflected in the direction of the installation surface such that a particularly efficient ceiling brightening occurs. The reflection element appears unlighted from below in this case.

It is, however, alternatively also possible to make the reflection element as a scattering plate only reflecting for a portion of the incident light and light permeable for another portion of the incident light. In this case, only the reflected portion of the light serves for the ceiling brightening, whereas the portion of the light passing through the reflection element results in a diffuse, scattering room lighting which starts from the lower side of the reflection element. When the reflection element is viewed from below, it appears lighted in the said case. However, no glare effect is caused by the reflection element since the portion of the light passing through the reflection unit only exits it as scattered light.

It is furthermore possible to provide the reflection element with transparent regions or openings through which light can pass without hindrance through the reflection element from the space lying between the installation surface and the reflection element. Design effects can thus be achieved, on the one hand, and a more efficient lighting, on the other hand, by the said transparent regions or openings.

The reflection element in accordance with the invention can be connected to the reflector releasably and/or replaceably. A replacement of the reflection element is in particular interesting under design aspects since, depending on the light mood to be achieved, reflection elements with different shapes, a different optical behavior and/or different colors can be used without any changes having to be made to the rest of the built-in lamp.

It is in particular possible to arrange a plurality of reflection elements outside the reflector which can, for example, have sizes and/or colors differing from one another. This plurality of reflection elements can, for example, extend parallel to one another and can have different spacings to the installation surface.

Different possibilities exist for the lighting of the reflection element taking place from above via the region disposed between the installation surface and the reflection element.

For example, the reflector can be made translucent or transparent at least sectionally in its region extending beyond the installation surface or it can be provided with openings so that light from the interior of the reflector can pass into the region lying between the reflection element and the installation surface and then ultimately illuminates the reflection element from above. In this case, the reflection element can take over an additional masking function since it can prevent light from moving directly from the outer side of the translucent or transparent reflector into the eye of the observer.

Alternatively or additionally, it is possible, for example, to provide an additional light discharge region—in addition to the reflector—which surrounds the reflector at least regionally and via which the reflection element can be illuminated by a portion of the light which does not come from the interior of the reflector. This additional light discharge region can extend in a plane which coincides at least substantially with the plane of the installation surface or which extends perpendicular or obliquely to the plane of the installation surface.

It is particularly preferred for the interior space of the reflector and the additional light discharge region to be illuminated by a common illuminant, since in this way no separate illuminant has to be provided for the additional light discharge region. No additional illuminant costs thus arise with respect to built-in lamps known from the prior art and a change of the illuminant can also take place with the same effort as with already known built-in lamps.

It is advantageous for the reflector to have a first reflector opening disposed in the main direction of illumination and a second reflector opening disposed opposite to the main lighting direction, with an additional reflector or background reflector being associated with the second reflector opening. The additional reflector or background reflector disposed behind the second reflector opening opposite to the main direction of illumination can thus illuminate both the reflector itself and on the described additional light discharge region. With an arrangement of this kind, the illuminant radiates direct light into the main direction of illumination via the reflector, on the one hand, and in a direction opposite to the main direction of illumination to the additional reflector or background reflector, on the other hand, which deflects some of the light incident on it in the direction of the additional light discharge region and some of the light in the direction of the first reflector opening of the reflector in dependence on its design such that this additional reflector or background reflector also contributes to the increase in efficiency in the generation of direct light via the reflector.

It is preferred for a light passage region to be formed between the additional reflector or background reflector so that the additional reflector or background reflector can deflect that portion of light which is intended for the additional light discharge region past the outer side of the reflector to the said additional light discharge region. The additional light discharge region can be illuminated both via the additional reflector or background reflector and directly via the illuminant.

The additional reflector or background reflector can be made by at least one planar or suitably shaped reflector area which is made either specularly reflecting or diffusely reflecting. The ratio of the portions of the light directed to the first reflector opening of the reflector and to the additional light discharge region can be directly set by a suitable curvature or kinking of the additional reflector or background reflector. To achieve a high efficiency of the built-in lamp in accordance with the invention, the additional reflector or background reflector is shaped such that a high portion of the light passes to the first reflector opening and only a low portion of the light passes to the actual light discharge region.

It is particularly advantageous for the illuminant and the reflector to be arranged in a housing which is in particular lightproof and/or dustproof and whose inner surface is made at least regionally as an additional reflector or background reflector. When a housing of this kind which is open in the main direction of illumination is used, the housing base can in particular be made as a planar or suitably curved or kinked reflector surface which forms at least one region of the additional reflector or background reflector. The side walls of a housing of this kind can also be made to be specularly reflecting or diffusely reflecting and can thus act as further reflector regions. When the housing base or the housing side walls are formed as an additional reflector or background reflector, it is achieved in an advantageous manner that no additional components are required for this reflector. It is only necessary to equip the housing with the respectively desired reflection behavior on the inner side.

It is advantageous with respect to the housing for it to be made lightproof, since in this case, for example, irregularities in the finishing are not illuminated from behind in an unintended manner with suspended ceilings. The housing can furthermore be made dustproof in order thus to counter contamination of the illuminant and reflectors caused, for example, by air-conditioning systems.

The reflector intended for the actual room illumination is preferably made as specularly reflecting on its inner side—like the reflectors of known built-in lamps—to achieve a defined illumination characteristic and a good efficiency. On its outer side, the reflector can be made specularly reflecting or diffusely reflecting so that the light illuminating the additional light discharge region can also be guided over the outer side of the reflector. The outer side of the reflector in this case forms a region of the additional reflector or background reflector.

The housing of the built-in lamp in accordance with the invention can be terminated in at least largely a dustproof manner by a translucent or transparent plate in the region of the additional light discharge region and by a further plate, in particular a transparent plate, in the region of the first opening of the reflector disposed in the main direction of illumination. In this manner, a largely dustproof design of the total arrangement can be achieved with a corresponding design of the housing.

It is particularly preferred for the reflector to be releasable from the housing, optionally together with the reflection element. The illuminant is particularly easily accessible by such a release of the reflector from the housing so that an easy replacement is possible. This is in particular of advantage when elongated illuminants are used whose longitudinal extent extends perpendicular to the main direction of illumination.

The reflector can specifically be supported at the housing in an articulated manner, for example, or can be fastened by means of a releasable screw connection, magnet connection, clip connection, latch connection or bayonet connection.

It is preferred for the reflector to be displaceably supported in the housing in the main direction of illumination. On the one hand, the spacing between the reflection element and the installation surface or room ceiling can be changed by such a displaceability, whereby the size of the region in which the room ceiling appears brightened can be set. On the other hand, the relative position of the reflector can be changed with respect to the illuminant by the said displaceability, whereby the illumination characteristic of the built-in lamp in accordance with the invention can be varied in the respectively desired manner.

The built-in lamp in accordance with the invention can be operated with any desired illuminants. It is preferred for an elongate illuminant in the form of a compact fluorescent lamp to be used whose longitudinal direction of extent either coincides with the main direction of illumination or extends perpendicular thereto. If the longitudinal extent extends perpendicular to the main direction of illumination, a particularly good ceiling brightening can be achieved since, in this case, a comparatively relevant portion of the light can pass to the reflection element, for example, through the partly light permeable reflector.

Further preferred embodiments of the invention are described in the dependent claims.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
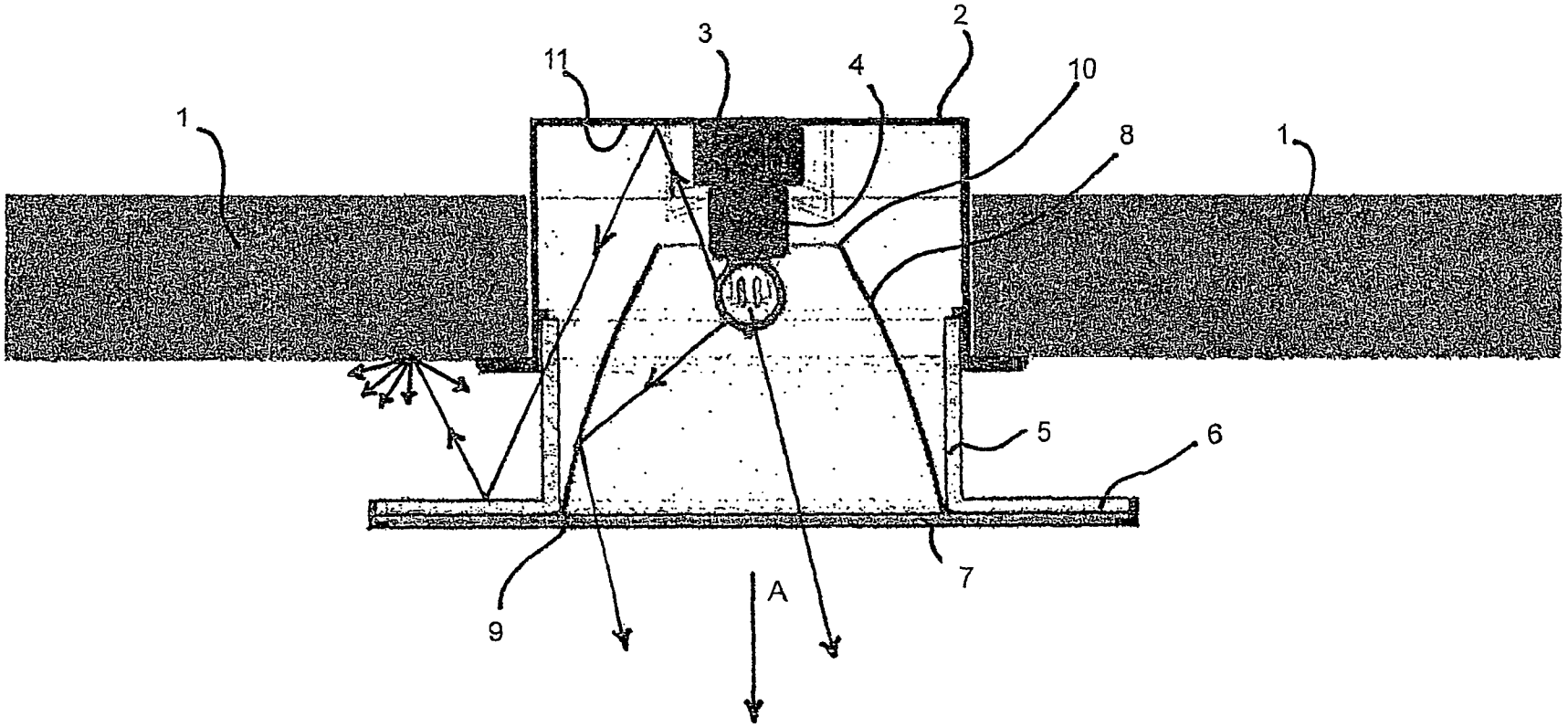
FIG. 1 is a sectional representation of a first embodiment of a built-in lamp in accordance with the invention.

The following description is merely exemplary in nature and is not intended to limit the present disclosure, application, or uses. It should be understood that throughout the drawings, corresponding reference numerals indicate like or corresponding parts and features.

FIG. 1 shows a substantially cylindrical housing 2 which is secured in a room ceiling 1 and is open at the bottom, with an illuminant fitting 3 being provided in the region of the housing base into which an illuminant 4 is inserted.

In the marginal region of the housing opening, the housing 2 is coupled at the inner side with a translucent or transparent cylindrical element 5 which forms an additional light discharge region. The cylindrical element 5 projects out of the housing 2 in the main direction of illumination A and has a collar 6 at its end remote from the housing 2 which extends horizontally parallel to the room ceiling 1, has a circular ring shape and forms the reflection element in accordance with the invention.

At the lower side of the collar 6, a transparent plate 7 is attached—extending parallel thereto—whose diameter corresponds to the outer diameter of the circular ring-shaped collar 6. The interior space of the housing 2 is terminated in a dustproof manner by the cylindrical element 5, the collar 6 and the plate 7.

In the region present between the plate 7 and the illuminant fitting 3, a dome-shaped or cupola-shaped reflector 8 is provided which has a first larger reflector opening 9 at its side remote from the illuminant mount 3. The reflector 8 furthermore has a second smaller reflector opening 10 at its side facing the illuminant fitting 3. The reflector extends from that region in which the cylindrical element 5 and the collar 6 are adjacent to one another up to approximately the center of the housing 2 so that the light emitting region of the illuminant 4 comes to lie in the upper region of the inner space of the reflector. It is achieved by the said arrangement that the reflector 8 extends downwardly beyond the installation surface or the room ceiling 1 into the main direction of illumination A.

On the operation of the built-in lamp in accordance with FIG. 1, the illuminant 4 radiates a comparatively large portion of the light in the direction of the plate 7 and in the direction of the inner wall of the reflector 8. Two ray extents are shown by way of example in FIG. 1 in this respect. The said portion of the light ultimately effects a direct illumination of a room located beneath the room ceiling 1 directed in the main direction of illumination A. This direct illumination takes place in accordance with the dark-light principle since the illuminant 4 is no longer visible from a specific angle of observation of the built-in lamp shown and thus cannot develop any glare effect.

A smaller portion of the light passes from the illuminant 4 to the base of the housing 2 which is made as an additional reflector or background reflector 11 and accordingly has specularly reflecting or diffusely reflecting properties. The additional reflector or background reflector 11 reflects the light incident on it in the direction of the cylindrical element 5 which, as already mentioned, is translucent or transparent. The said portion of the light thus passes through the cylindrical element 5 until it is incident on the collar 6 formed in a specularly reflecting manner on its upper side. The said portion of the light is reflected from there in the direction of the room ceiling 1 which is diffusely reflecting as a rule. The light reflected diffusely by the room ceiling 1 is thus visible in a pleasant manner without any glare effect occurring here. The ray extent described is illustrated by way of example with reference to a light ray in FIG. 1.

Figure 2:
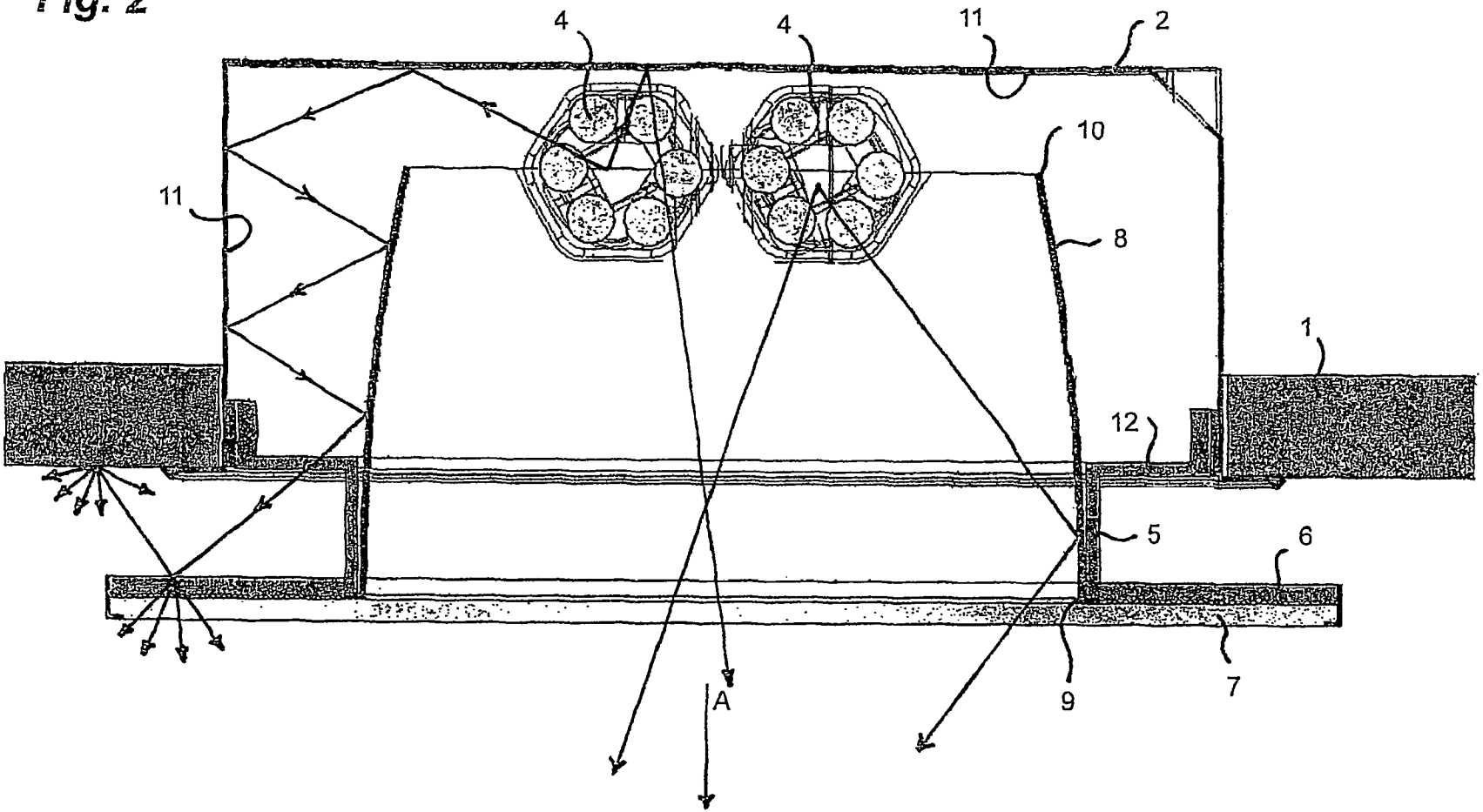
FIG. 2 is a sectional representation of a second embodiment of a built-in lamp in accordance with the invention.

FIG. 2 shows a further embodiment of a built-in lamp in accordance with the invention, with elements corresponding to one another in FIGS. 1 and 2 each being designated with the same reference numerals. The same applies accordingly to the FIGS. 3 and 4 explained in the following.

A housing 2 is also in turn secured in a room ceiling 1 in accordance with FIG. 2. The housing inner side is specularly reflecting so that it forms an additional reflector or background reflector 11.

A reflector 8 with a first larger reflector opening 9 and a second smaller reflector opening 10 is provided in the housing 2 and its region disposed in the main direction of illumination A extends beyond the installation surface or the room ceiling 1.

The reflector 8 is connected to a cylindrical element 5 which likewise extends beyond the room ceiling 1 in the main direction of illumination A and is connected analog to FIG. 1 in its marginal region disposed in the main direction of illumination to a collar 6 extending perpendicular thereto.

Unlike the embodiment in accordance with FIG. 1, the cylindrical element 5 is connected in its marginal region remote from the collar 6 to a horizontally extending ring element 12 which extends substantially from the outer side of the reflector 8 up to the side wall of the housing 2 within the plane of the room ceiling 1. The ring element 12, cylindrical element 5 and collar 6 can be made in one piece and light permeable or transparent.

In the base-side region of the housing 2, two illuminants 4 each designed as compact fluorescent lamps are provided whose longitudinal extent extends perpendicular to the main direction of illumination A, with the provision of only one compact fluorescent lamp 4 also being alternatively possible. The illuminants 4 are arranged relative to the reflector 8 such that they are located approximately half in the interior space of the reflector 8 and half in the intermediate space formed between the housing base and the reflector 8. Alternatively, the illuminants 4 could also be located completely within the intermediate space formed between the housing base and the reflector 8 and thus completely above the reflector 8.

The outer side of the reflector 8 is made to be specularly reflecting, just like its inner side, with the outer side of the reflector 8 also being able to be made diffusely reflecting, for example.

Analog to FIG. 1, the collar 6 is coupled to a plate 7 such that the inner space of the housing 2 in accordance with FIG. 2 is also terminated in a dustproof manner.

In the operation of the built-in lamp in accordance with FIG. 2, direct light is discharged from the first reflector opening 9 through the plate 7 into the space to be illuminated located beneath the room ceiling 1. This direct light comes either directly from the illuminants 4 or it is previously reflected at the housing base formed as an additional reflector or background reflector 11 and/or at the inner wall of the reflector 8. Corresponding ray extents are shown by way of example in FIG. 2.

A small portion of the light is transmitted in the direction of the housing base from the illuminants 4 at such an angle that it subsequently passes through the transparent ring element 12 onto the upper side of the collar 6 by multiple reflection between the housing side wall and the outer side of the reflector 8. The collar 6 is made, for example, as a diffuser plate or is provided with a prismatic structure so that it reflects some of the light incident on it and is permeable for a further portion of the light, with the last named portion of the light being converted into diffuse light due to the optical properties of the collar 6. This diffuse light is incident onto the lower side of the collar 6 through the plate 7 so that the collar 6 appears illuminated when viewed from below. Since, however, only diffuse light passes through the plate 7 in the region of the collar 6, this portion of the light does not develop any glare effect. The portion of the light reflected by the upper side of the collar 6 passes—analog to FIG. 1—to the room ceiling 1, from where it is diffusely reflected.

For an observer of the built-in lamp in accordance with FIG. 2, an illuminated ring region of the room ceiling 1 as well as an illuminated collar 6 are therefore always visible, without the collar 6 and the room ceiling 1 respectively being able to develop a glare effect. At the same time, efficient room lighting in the main direction of illumination A is ensured in accordance with the dark-light principle via the larger reflector opening 9.

Figure 3:
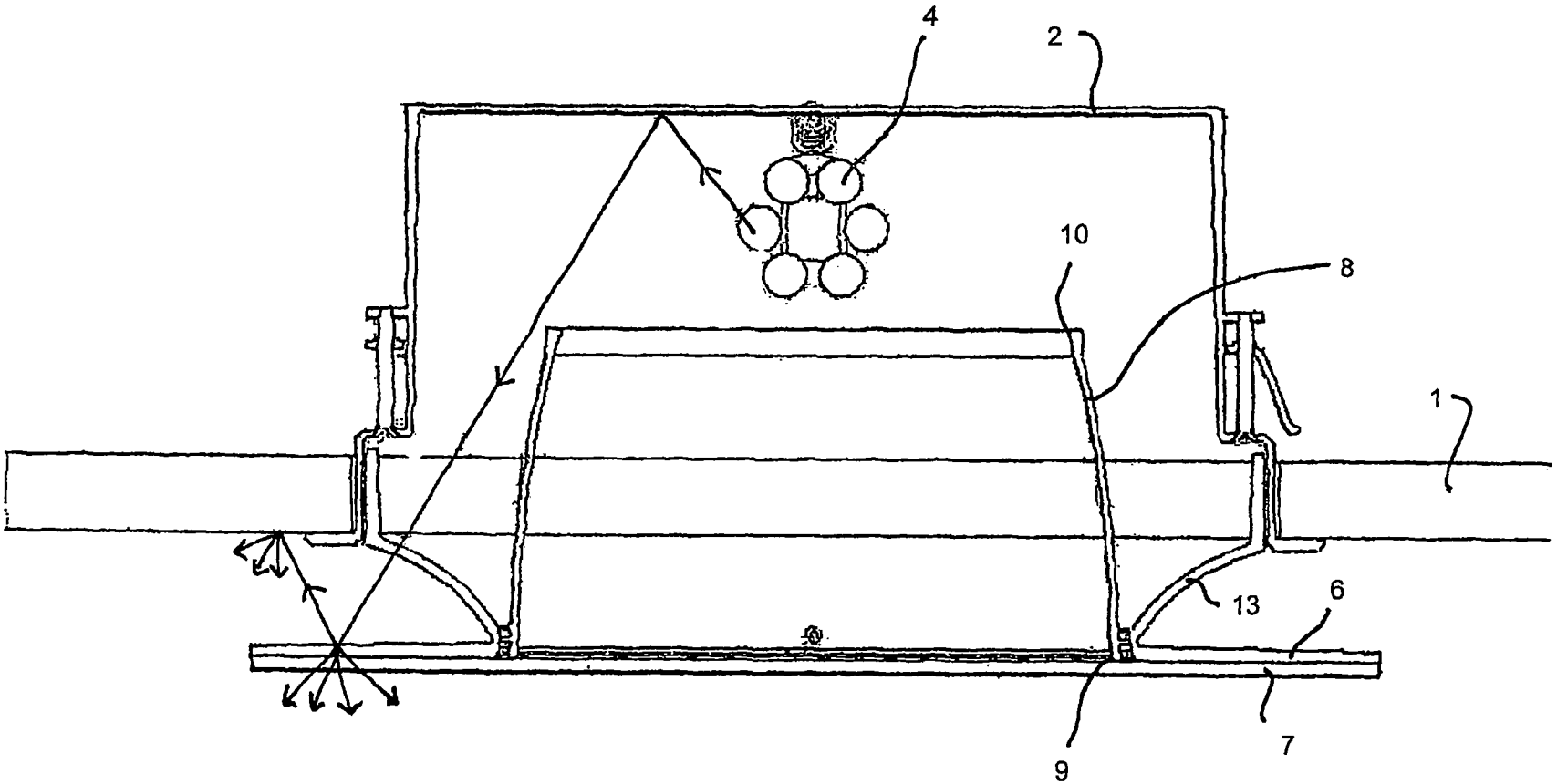
FIG. 3 is a sectional representation of a third embodiment of a built-in lamp in accordance with the invention.

FIG. 3 shows an embodiment of a built-in lamp in accordance with the invention which coincides in a series of features with the embodiment in accordance with FIG. 2. Accordingly—to the extent that corresponding elements are present—the same reference numerals are used in FIG. 3 as in FIG. 2.

Unlike FIG. 2, only a single lamp 4 is provided which is positioned such that it is located completely between the base of the housing 2 and the second or upper reflector opening 10. The illuminant 4 thus does not extend into the inner space of the reflector 8.

Furthermore, in the embodiment in accordance with FIG. 3, a light passage element 13 is provided instead of the cylindrical element 5 and of the ring element 12 in accordance with FIG. 2. The light passage element 13, which can in particular be made integrally with the collar 6, substantially has a circular ring shape and is concavely arched, with it extending from the first or lower reflector opening 9 up to the margin of the housing 2 contacting the ceiling element 1. The arched embodiment of the light passage element 13 in accordance with FIG. 3 permits an even more efficient illumination of the collar 6 by light coming from the illuminant 4 with respect to FIG. 2 such that the ceiling brightening is improved even further.

Figure 4:
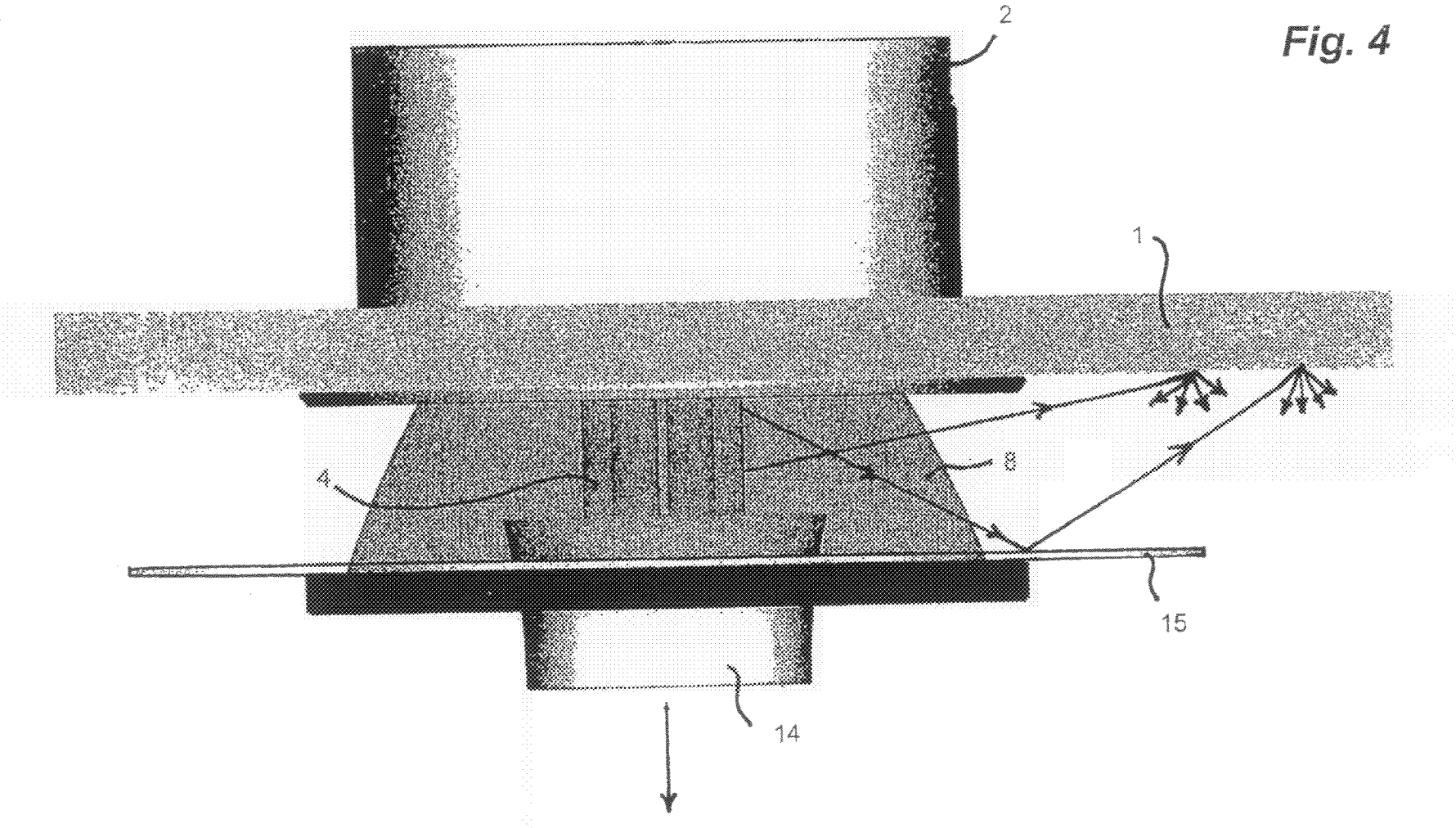
FIG. 4 is a side view of a fourth embodiment of a built-in lamp in accordance with the invention with a reflection element.

FIG. 4 shows a side view of a further embodiment of a built-in lamp in accordance with the invention secured in a room ceiling 1. This built-in lamp also has a cylindrical, cup-shaped housing 2 in which a reflector 8 is held. The reflector 8 extends in the main direction of illumination A beyond the room ceiling 1 and is—unlike FIGS. 1 and 2—displaceably supported in the main direction of illumination in the housing 2. The reflector 8 can, for example, be guided or supported in the housing 2 such that it can be latched there in two or more different vertical positions.

In the housing 2, an illuminant 4 made as a compact fluorescent lamp is arranged whose longitudinal extent coincides with the main direction of illumination A. The illuminant 4 extends in this respect from the interior of the housing 2 up to and into the end region of the reflector 8 disposed in the main direction of illumination A. In this region, the illuminant is surrounded by a substantially annular, central additional masking reflector 14 which prevents the illuminant 4 from developing an irritating glare effect in its end region disposed in the main direction of illumination A.

A circular ring-shaped reflection element 15 lies loosely on the lower end region of the reflector 8 forming a horizontal support surface and takes over the function of the collar 6 in accordance with FIGS. 1 and 2.

A substantial difference between the embodiments in accordance with FIGS. 1 and 2, on the one hand, and the embodiment in accordance with FIG. 4, on the other hand, lies in the fact that the reflector 8 in accordance with FIG. 4 is at least partially light permeable so that a preferably low portion of light can pass through it and be incident on the upper side of the reflection element 15. This portion of the light is then reflected by the upper side of the reflection element 15 in the direction of the room ceiling 1, which in turn produces the ceiling brightening in accordance with the invention. A corresponding, exemplary ray extent is illustrated in FIG. 4. In addition, a further portion of the light also passes through the reflector 8 directly onto the room ceiling 1, which is likewise shown by way of example with reference to a further ray extent in FIG. 4.

The reflector 8 in accordance with FIG. 4 could also be made completely transparent and only be provided with a prismatic structure at its inner side, which ensures that sufficient direct light exits the reflector 8 through the reflector opening disposed in the main direction of illumination A. With this transparent embodiment, it is achieved thanks to the increased light permeability of the reflector 8 that a comparatively large portion of the light is available for the ceiling brightening.

An enlargement of the brightened ring region of the room ceiling 1 can be achieved by a downward adjustment or displacement of the reflector 8. A reduction in size of the brightened ring region of the room ceiling 1 can accordingly be achieved by an upward adjustment or displacement of the reflector 8.

Figure 5:
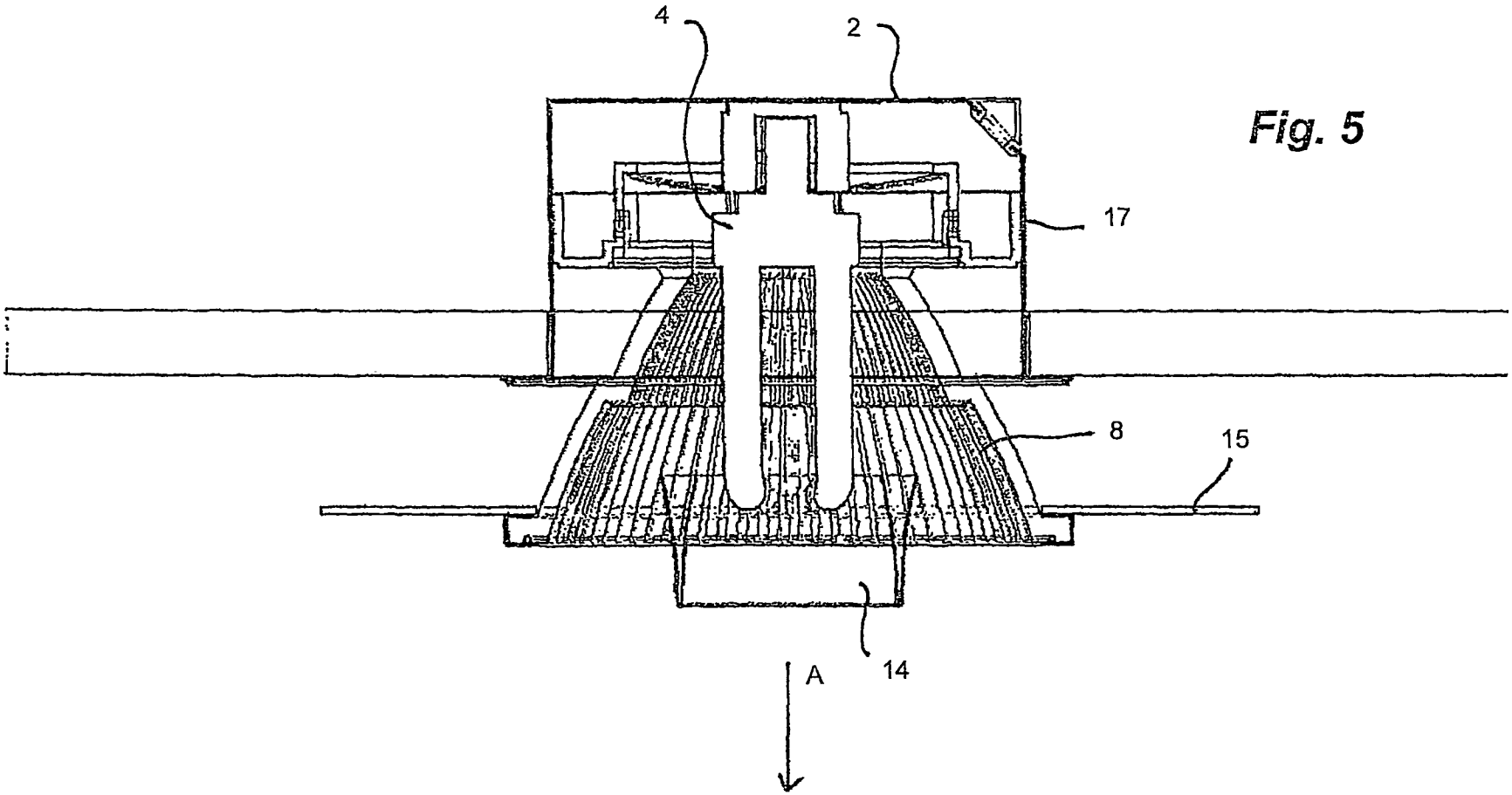
FIG. 5 is a sectional representation of a fifth embodiment of a built-in lamp in accordance with the invention.

FIG. 5 shows an embodiment of a built-in lamp in accordance with the invention in which the reflector 8 is held vertically displaceably in the housing 2 analog to FIG. 4. Components of the built-in lamp shown in FIG. 5 which correspond to one another are designated by the same reference numerals also used in FIG. 4.

The illuminant 4 is firmly connected to the base of the housing 2 via its fitting and thus not held vertically displaceably in the housing 2 together with the reflector 8. The reflector 8 is in contrast held in the housing 2 via a plain bearing 17, with the plain bearing 17 enabling a vertical movement of the reflector 8 in the main direction of illumination A and opposite to the main direction of illumination A. Due to the said displaceability, the reflector 8 can be moved either further into the housing 2 or further out of it, whereby the illumination characteristic of the built-in lamp shown changes with respect to the generated direct lamp due to the statically arranged illuminant 4 and at the same time the size of the ceiling region brightened by the reflection element 15 can also be influenced.

Figure 6:
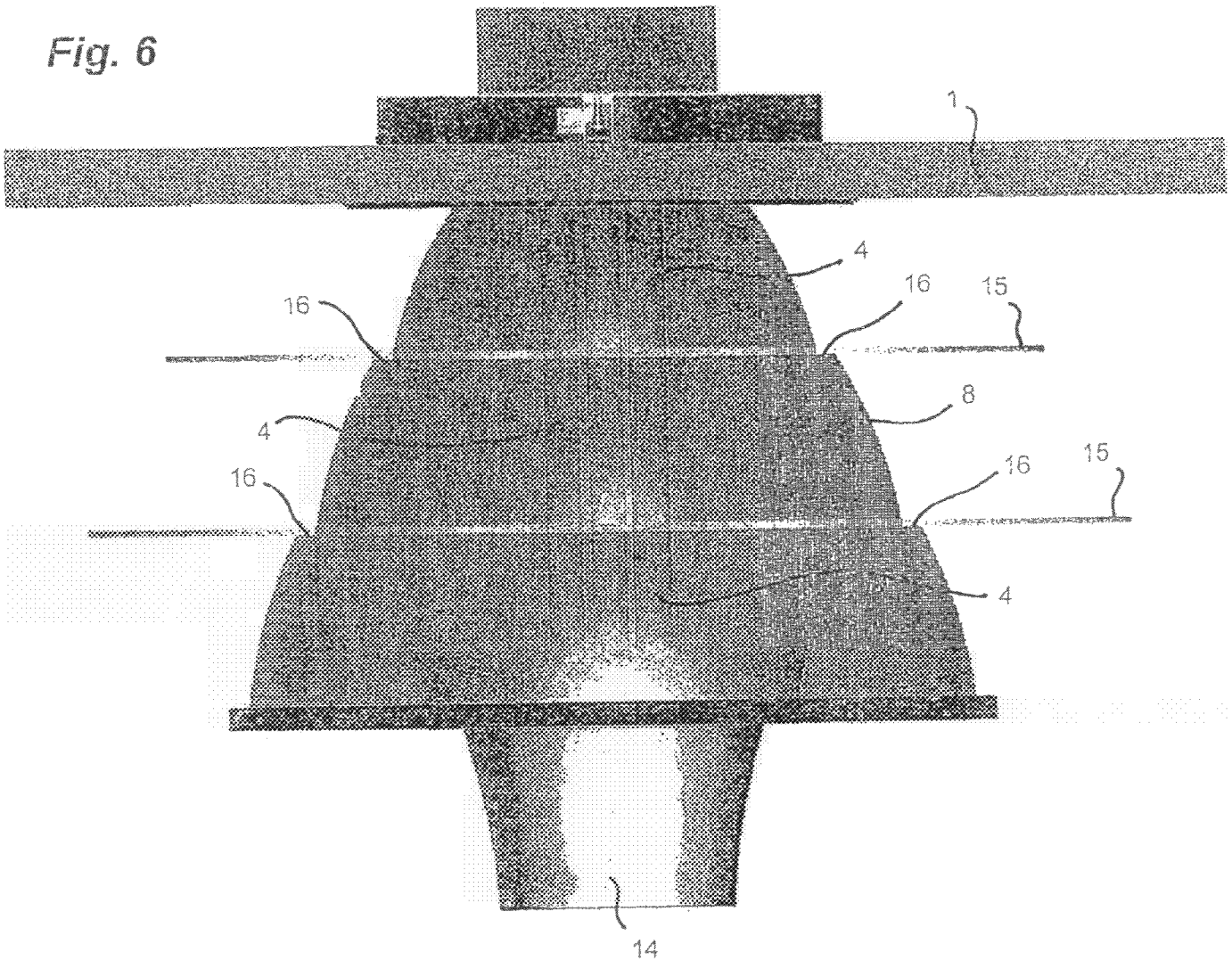
FIG. 6 is a side view of a sixth embodiment of a built-in lamp in accordance with the invention with two reflection elements.

FIG. 6 shows an embodiment corresponding to FIG. 4 with respect to its manner of function with a partly or completely transparent reflector 8, with a stepped reflector 8, however, being used in accordance with FIG. 6. This step shape of the reflector 8 has the effect that two ring-shaped support surfaces 16 are formed at its outer side and the respective reflection elements 15 in accordance with FIG. 4 can be placed on them. These reflection elements 15, like the reflection element 15 in accordance with FIG. 4, have a central, circular cut-out which corresponds to the outer diameter of the reflector 8 in the respectively relevant region. The outer diameter of the upper circular ring-shaped reflection element 15 is dimensioned smaller than the outer diameter of the lower reflection element 15.

Alternatively, three or more steps could also be provided for the support of a corresponding number of reflection elements.

A third reflection element could in particular be arranged in the lower end region of the reflector 8. The three reflection elements together can take over an additional masking function in this case since—at corresponding viewing angles—they can fully prevent light from passing from the illuminant itself or directly from the outer side of the translucent or transparent reflector into the eye of the viewer.

In the embodiment in accordance with FIG. 6, both reflection elements 15 accordingly contribute to a ceiling brightening in accordance with the principle described in connection with FIG. 4 since both reflection elements 15 are illuminated by light coming from the illuminant 4 via the partly light permeable reflector 8.

The description of the invention is merely exemplary in nature and, thus, variations that do not depart from the gist of the invention are intended to be within the scope of the invention. Such variations are not to be regarded as a departure from the spirit and scope of the invention.

REFERENCE NUMERAL LIST

1 room ceiling
2 housing
3 illuminant fitting
4 illuminant
5 cylindrical element
6 collar
7 plate
8 reflector
9 first reflector opening
10 second reflector opening
11 additional reflector or background reflector
12 ring element
13 light passage element
14 additional reflector
15 reflection element
16 support surfaces
17 plain bearing

What is claimed is:

1. A built-in lamp having a holder for fastening in an installation surface (1) having an illuminant fitting (3) and having a reflector (8), the holder and reflector (8) being arranged relative to one another such that the reflector (8) extends beyond the installation surface (1) in a main direction of illumination (A) with a built-in lamp secured in the installation surface (1), with the reflector being coupled in this region extending beyond the installation surface to a reflection element (6, 15) which extends transversely to the main direction of illumination (A) and is spaced from the installation surface, the reflection element (6, 15) is arranged outside the reflector (8) and is illuminated by light via the region lying between the installation surface (1) and the reflection element (6, 15) so that at least a portion of the light impinging the reflection element is reflected in a direction opposite from said main direction and directly against the installation surface thus illuminating the installation surface, wherein the light is provided by at least one of the reflector (8), which is made translucent or transparent at least sectionally in its region extending between the installation surface (1) and the reflection element (15), so that the reflection element (15) is illuminated by a portion of the light.

2. A built-in lamp in accordance with claim 1, wherein the reflection element (6, 15) is made as reflecting or as specularly reflecting at its side facing the installation surface (1).

3. A built-in lamp in accordance with claim 1, wherein the reflection element (6, 15) is made as a reflecting scattering plate for one portion of the incident light and as a light permeable scattering plate for another portion of the incident light.

4. A built-in lamp in accordance with claim 1, wherein the reflection element (6, 15) has transparent regions or openings.

5. A built-in lamp in accordance with claim 1, wherein the reflection element (6, 15) is releasably connected to the reflector (8).

6. A built-in lamp in accordance with claim 1, wherein a plurality of reflection elements (15) are arranged outside the reflector (8) which have different sizes to one another.

7. A built-in lamp in accordance with claim 1, wherein an additional light discharge region (5, 12, 13) in a plane which coincides at least substantially with the plane of the installation surface (1) or which extends perpendicular or obliquely to the plane of the installation surface (1).

8. A built-in lamp in accordance with claim 7, wherein the inner space of the reflector (8) and an additional light discharge region (5, 12, 13) is illuminated by a common illuminant (4).

9. A built-in lamp in accordance with claim 1, wherein the reflector (8) has a first reflector opening (8) disposed in the main direction of illumination (A) and a second reflector opening (10) disposed opposite to the main direction of illumination (A), with an additional reflector (11) being associated with the second reflector opening (10).

10. A built-in lamp in accordance with claim 9, wherein a light passage region is formed between the additional reflector (11) and the reflector (8).

11. A built-in lamp in accordance with claim 9, wherein the additional reflector (11) is formed at least partly by at least one planar or presettably curved or kinked reflector surface which ensures a presettable division of the portion of the reflected light directed to the reflector (8) and to an additional light discharge region (5, 12, 13).

12. A built-in lamp in accordance with claim 1, wherein the illuminant (4) and the reflector (8) are arranged in a housing (2) which is lightproof and/or dustproof and whose inner surface is made at least regionally as an additional reflector (11).

13. A built-in lamp in accordance with claim 12, wherein the additional reflector (11) is made as specularly reflecting or diffusely reflecting.

14. A built-in lamp in accordance with claim 1, wherein the reflector (8) is made specularly reflecting or diffusely reflecting on its outer side.

15. A built-in lamp in accordance with claim 1, wherein an opening (9) of the reflector (8) is disposed in the main direction of illumination and is open.

16. A built-in lamp in accordance with claim 15, wherein a housing (2) is terminated in an at least largely dustproof manner by a translucent or transparent plate in the region of the additional light discharge region (5, 12, 13) and by a transparent plate (7), in the region of the opening (9) of the reflector (8) disposed in the main direction of illumination.

17. A built-in lamp in accordance with claim 1, wherein the reflector (8) is released from a housing (2).

18. A built-in lamp in accordance with claim 17, wherein the reflector (8) is supported at the housing (2) in an articulated manner and is fastened by means of one of a releasable screw connection, magnet connection, clip connection, latch connection and bayonet connection.

19. A built-in lamp in accordance with claim 17, wherein the reflector (8) is displaceably supported in the housing (2) in the main direction of illumination (A).

20. A built-in lamp in accordance with claim 1, wherein an elongated illuminant (4) is provided in the reflector (8) and its longitudinal direction of extent coincides with the main direction of illumination (A) or its longitudinal direction of extent extends perpendicular to the main direction of illumination (A).

21. A built-in lamp having a holder for fastening in an installation surface (1) having an illuminant fitting (3) and having a reflector (8), the holder and reflector (8) being arranged relative to one another such that the reflector (8) extends beyond the installation surface (1) in a main direction of illumination (A) with a built-in lamp secured in the installation surface (1), with the reflector being coupled in this region extending beyond the installation surface to a reflection element (6, 15) which extends transversely to the main direction of illumination (A) and is spaced from the installation surface, the reflection element (6, 15) is arranged outside the reflector (8) and is illuminated by light via the region lying between the installation surface (1) and the reflection element (6, 15) so that at least a portion of the light impinging the reflection element is reflected in a direction opposite from said main direction and directly against the installation surface thus illuminating the installation surface without passing through any further elements of the built-in lamp, wherein the light is provided by at least one additional light discharge region (5, 12, 13) which extends around an outer perimeter of the reflector (8), so that the reflection element (6, 15) is illuminated by a portion of the light.

* * * * *